US005369339A

United States Patent [19]

Reijnaerts

[11] Patent Number: 5,369,339

[45] Date of Patent: Nov. 29, 1994

[54] CIRCUIT ARRANGEMENT FOR REDUCING STRIATIONS IN A LOW-PRESSURE MERCURY DISCHARGE LAMP

[75] Inventor: Jozef H. Reijnaerts, Eindhoven, Netherlands

[73] Assignee: U.S. Philips Corporation, New York, N.Y.

[21] Appl. No.: 963,869

[22] Filed: Oct. 20, 1992

[30] Foreign Application Priority Data

Dec. 16, 1991 [EP] European Pat. Off. ..... 912032954.3

[51] Int. Cl.[5] ..... H05B 37/02

[52] U.S. Cl. ..... 315/209 R; 315/207; 315/224; 315/226; 315/DIG. 7

[58] Field of Search ..... 315/209 R, 207, 176, 315/224, DIG. 5, DIG. 7, 344, 226

[56] References Cited

U.S. PATENT DOCUMENTS

| | | | |
|---|---|---|---|
| 5,001,386 | 3/1991 | Sullivan et al. | 315/219 |
| 5,041,763 | 8/1991 | Sullivan et al. | 315/176 |
| 5,066,894 | 11/1991 | Klier | 315/224 |
| 5,103,138 | 4/1992 | Orenstein et al. | 315/DIG. 5 |
| 5,189,343 | 2/1993 | Pacholok | 315/219 |

FOREIGN PATENT DOCUMENTS 8606572 6/1986 WIPO .

*Primary Examiner*—James B. Mullins
*Assistant Examiner*—Jim Dudek
*Attorney, Agent, or Firm*—Laurie E. Gathman

[57] ABSTRACT

A circuit arrangement for operating a low-pressure mercury discharge lamp by a high-frequency current which includes a DC component and a high-frequency AC component. The circuit arrangement has a switching device for generating the high-frequency AC component from a supply voltage, an asymmetry device for rendering a first amplitude of the high-frequency AC component in a first polarization direction and a second amplitude of the high-frequency AC component in a second polarization direction unequal to one another, and a DC device for generating the DC component. The polarity of the DC component coincides with the polarization direction of the greater of the two amplitudes. Thus, striations in a low-pressure mercury discharge lamp operated on the circuit arrangement can be rendered invisible over a wide range of powers consumed by the lamp.

12 Claims, 4 Drawing Sheets

CIRCUIT ARRANGEMENT FOR REDUCING STRIATIONS IN A LOW-PRESSURE MERCURY DISCHARGE LAMP

FIELD OF THE INVENTION

The invention relates to a circuit arrangement for operating a low-pressure mercury discharge lamp by a high-frequency current which includes a DC component G and a high-frequency AC component W, comprising a switching device for generating the high-frequency AC component W from a supply voltage, an asymmetry device for rendering an amplitude A1 of the high-frequency AC component W in a first polarization direction and an amplitude A2 of the high-frequency AC component W in a second polarization direction unequal to one another, and a DC generating device III for generating the DC component G.

BACKGROUND OF THE INVENTION

Such a circuit arrangement is known from International Patent Application WO 86/06572. Striations are formed in a low-pressure mercury discharge lamp (referred to hereinafter as the lamp) operated by the known circuit arrangement, i.e. alternating comparatively dark and comparatively light regions in the plasma of the lamp. The striations often move through the lamp. The direction in which and the velocity at which the striations move through the lamp depend both on the ratio between amplitude A1 and amplitude A2 and on the amplitude and polarity of the DC component G. This renders it possible to adjust the speed with which striations move through the lamp by using the asymmetry device and/or the DC device. The known circuit arrangement thus offers the possibility, for example, of making striations substantially stationary in the lamp, which may be desirable, for example, in lamps which are used for advertising purposes. A second possibility of the known circuit arrangement is to use the asymmetry device and/or DC generating device for making the velocity of the striations so great that the human eye is substantially incapable of observing them any more. As a result, it appears to an observer that the brightness in the lamp is substantially uniform, and that objects in the vicinity of the lamp are evenly illuminated. These two effects of the second possibility are desirable in the majority of practical applications of the lamp, i.e. that it is substantially always desirable to render striations in the lamp invisible. Factors which influence the occurrence of striations are inter alia the ambient temperature of the lamp, the power consumed by the lamp, and the composition of the lamp plasma. It has been found that it is not or substantially not possible under unfavorable conditions to render striations invisible through the exclusive use of the asymmetry device II or the DC generating device. Since the known circuit arrangement is provided with both the asymmetry device and the DC generating device, it is possible in principle to influence the velocity with which striations move through the lamp more strongly than would be possible with a circuit arrangement which is provided only with a device for generating a DC component of the lamp current or which is provided only with a device for rendering an amplitude of a high-frequency alternating current through the lamp in a first polarization direction and an amplitude of the high-frequency alternating current in a second polarization direction unequal to one another. It was found, however, that the effect on the velocity with which the striations moved achieved by the asymmetry device II is in practice often opposed to the effect achieved by the DC generating device. The result of this is that, in spite of the combined use of the asymmetry device and the DC generating device, it is hardly possible to render striations invisible, and the known circuit arrangement functions ineffectively.

SUMMARY OF THE INVENTION

The invention has for its object inter alia to provide a circuit arrangement with which it is possible to render striations in the lamp substantially entirely invisible under widely differing operating conditions.

According to the invention, this object is achieved in that the polarity of the DC component G coincides with the polarization direction of the greater of the two amplitudes A1 and A2 in a circuit arrangement of the kind mentioned in the opening paragraph.

It was found that in a circuit arrangement according to the invention the effect of the asymmetry device on the velocity with which striations move through a lamp operated on the circuit arrangement and the effect of the DC generating device on this velocity reinforce one another. This makes it possible to render striations invisible in low-pressure mercury discharge lamps of various types and under widely differing operating conditions.

In an advantageous embodiment of a circuit arrangement according to the invention, the switching device comprises switches for generating a substantially square-wave voltage with a duty cycle D from a DC voltage, the asymmetry device comprises a device for rendering the duty cycle D unequal to 50%, and the circuit arrangement comprises in addition a load branch B which is coupled to the switching device and which comprises a series circuit of capacitive device C and lamp connection terminals K1 and K2. Since the duty cycle D of the substantially square-wave voltage is not equal to 50%, the time interval in each high-frequency cycle of the AC component W during which the AC component W flows in the first polarization direction is unequal to the time interval during which the AC component W flows in the second polarization direction. At the same time, the presence of the capacitive device C renders the quantity of charge displaced by the AC component W in the first polarization direction substantially equal to the quantity of charge displaced by the AC component W in the second polarization direction. These two conditions have the result that the amplitudes A1 and A2 of the AC component W have different values.

Another advantageous embodiment of the invention is characterized in that the DC generating device comprises a branch which comprises a series circuit of an impedance and a unidirectional element and which shunts the low-pressure mercury discharge lamp. The impedance may be, for example, a resistor. Especially if the lamp voltage is comparatively low, this branch constitutes a comparatively simple and efficiently operating embodiment of the DC generating device.

A further advantageous embodiment of a circuit arrangement according to the invention is characterized in that the circuit arrangement comprises a capacitive device connected in series with the lamp and shunted by a branch which comprises an impedance. In this advantageous embodiment, the impedance may also be, for example, a resistor. This embodiment of the DC generating device is particularly advantageous when the lamp voltage is comparatively high.

BRIEF DESCRIPTION OF THE DRAWINGS

Embodiments of the invention will be explained in more detail with reference to the drawings.

In the drawing.

Figure 1:
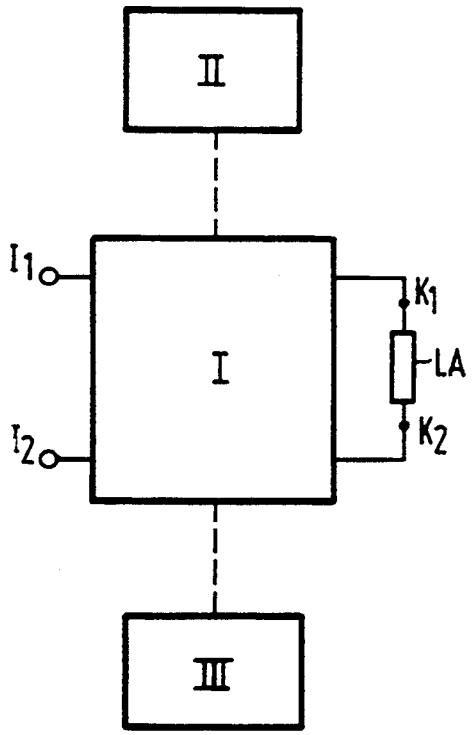
FIG. 1 shows a diagrammatic picture of an embodiment of a circuit arrangement according to the invention.

FIG. *2a* shows the embodiment of FIG. 1 in more detail;

FIG. *2b* shows another embodiment of the circuit arrangement in accordance with the invention which adds impedance R2 across the capacitor C in addition to the diode Di and impedance R1 across the lamp LA.

Figure 3:
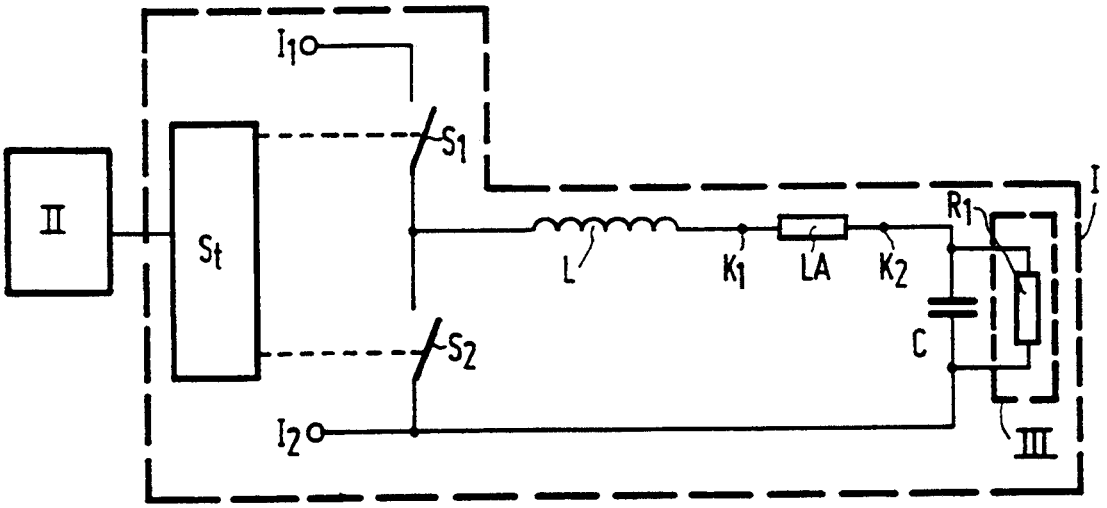
Figure 4:
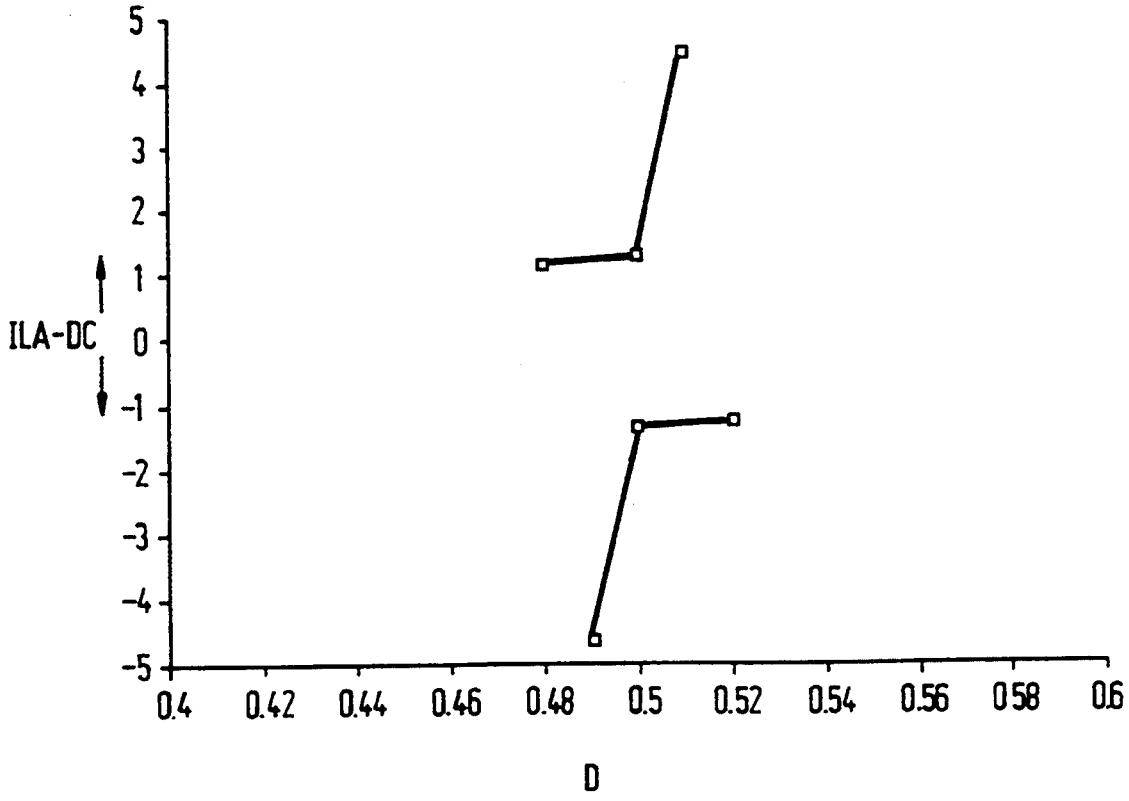
Figure 5A:
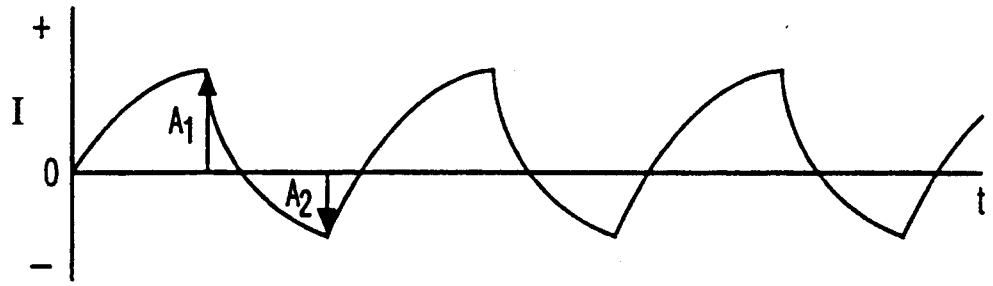
Figure 5B:
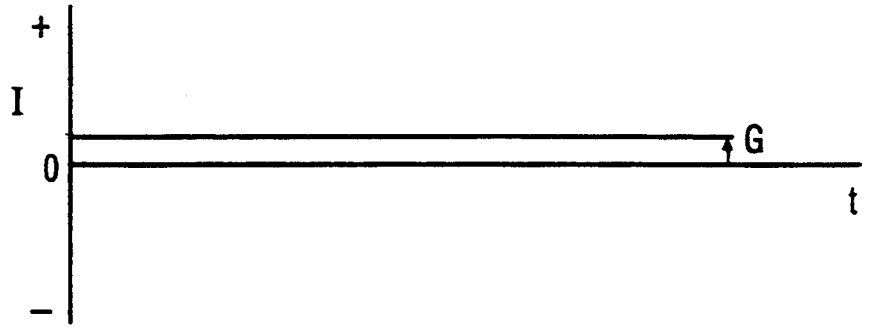
Figure 5C:
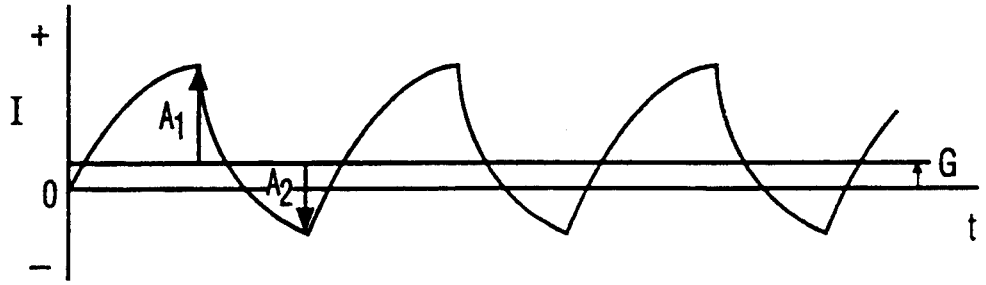

FIG. 3 shows a further embodiment of a circuit arrangement according to the invention;

FIG. 4 shows parameters of various operating conditions of a low-pressure mercury discharge lamp operated on a circuit arrangement as shown in FIG. 2, whereby striations in the low-pressure mercury discharge lamp are substantially invisible;

FIG. *5a* shows the asymmetric high frequency AC component having an amplitude in a first polarization direction which is greater than an amplitude in a second polarization direction;

FIG. *5b* shows the DC component having a polarity coincident with the larger amplitude of the asymmetric high-frequency AC component in FIG. *5a*; and FIG. *5c* shows the combined AC and DC components.

DETAILED DESCRIPTION OF THE PREFERRED EMBODIMENTS

In FIG. 1, I1 and I2 are input terminals suitable for connection to a supply voltage source. Block I, hereinafter switching device I, includes a switching device for generating a high-frequency AC component W from the supply voltage source. Switching device I is provided with lamp connection terminals K1 and K2 to which a lamp La is connected. Block II, hereinafter asymmetry device II, includes an Asymmetry device rendering an amplitude A1 of the high-frequency AC component W in a first polarization direction and an amplitude A2 of the high-frequency AC component W in a second polarization direction unequal to one another. Asymmetry device II is for this purpose coupled to switching device. Block III, hereinafter DC generating device III, includes a device for generating a DC component G. DC generating device is for this purpose also coupled to switching device I.

The operation of the circuit arrangement shown in FIG. 1 is as follows.

When the input terminals I1 and I2 are connected to a supply voltage source, a high-frequency current consisting of the high-frequency AC component W and the DC component G will flow through the lamp LA. The switching device I generates the high-frequency AC component W, whereas the DC generating device III generates the DC component G. Asymmetry device II renders the amplitude A1 of the high-frequency AC component W in a first polarization direction unequal to the amplitude A2 of the high-frequency AC component W in the second polarization direction as shown in FIG. *5a*. The polarity of the DC component G is chosen to be equal to the polarization direction of the greater of the two amplitudes A1 and A2 as shown in FIGS. *5b* and *5c*. This renders it possible to make striations invisible in lamps of differing types and over a comparatively wide range of powers consumed by the lamp.

In the circuit arrangements shown in FIG. *2a* and FIG. 3, the switching device I is constructed as an incomplete half bridge comprising a series circuit of input terminal I1, switching elements S1 and S2, and input terminal I2. The incomplete half bridge in addition comprises a load branch which shunts the switching element S2 and comprises a series circuit of a coil L, lamp connection terminal K1, lamp LA, lamp connection terminal K2, and capacitor C which in these embodiments forms the capacitive device C. Also part of the incomplete half bridge is the control circuit St which is coupled to the switching elements S1 and S2 for rendering the switching elements conducting and non-conducting with high frequency. Asymmetry device II is coupled to an input of the control circuit St. In the embodiment shown in FIG. 2, the DC generating device II is constructed as a series circuit of a diode Di and a resistor R1 which shunts the lamp LA. In the embodiment shown in FIG. 3, the DC generating device III is constructed as a resistor R1 which shunts the capacitor C.

The operation of the circuit arrangement shown in FIG. *2a* is as follows.

When input terminals I1 and I2 are connected to the positive and the negative pole of a DC voltage source, respectively, a high-frequency control signal generated by the control circuit St renders the two switching elements S1 and S2 alternately conducting and non-conducting with high frequency. As a result, a high-frequency, substantially square-wave voltage is present across the ends of the load branch. The duty cycle D of the high-frequency, substantially square-wave voltage is set for a value which is not equal to 50% by the asymmetry device II. A high-frequency alternating current flows through the load branch as a result of the high-frequency, substantially square-wave voltage. Since the duty cycle D of the high-frequency, substantially square-wave voltage is not equal to 50%, the amplitude of the alternating current in a first polarization direction is unequal to the amplitude of the alternating current in the second polarization direction. In addition, the diode Di only passes current in one polarization direction and is blocked in the other direction, so that the lamp current has a DC component G. To optimize the joint effect of asymmetry device II and DC generating device III on the visibility of striations, according to the invention, the duty cycle D is set for a value below 50% if, as shown in FIG. *2a*, the anode of diode Di is coupled to capacitor C and the cathode of diode Di is coupled to a junction point shared by the two switching elements. If, on the other hand, the anode of diode Di is coupled to a junction point shared by the two switching element S1 and S2 and the cathode of diode Di is coupled to capacitor C, the joint effect of the asymmetry device II and DC generating device III is at its optimum when the value of the duty cyle D is chosen to lie above 50%.

The operation of the circuit arrangement shown in FIG. 3 largely corresponds to that of the circuit arrangement shown in FIG. *2a*. The difference consists in that the DC component G of the current through the lamp LA in this embodiment is realized by the resistor R1 which shunts the capacitor C. An optimization according to the invention of the joint effect of asymmetry device and DC generating device III on the invisibility of striations in the lamp is achieved in this embodiment when the duty cycle D is chosen to be lower than 50%.

Figure 2A:
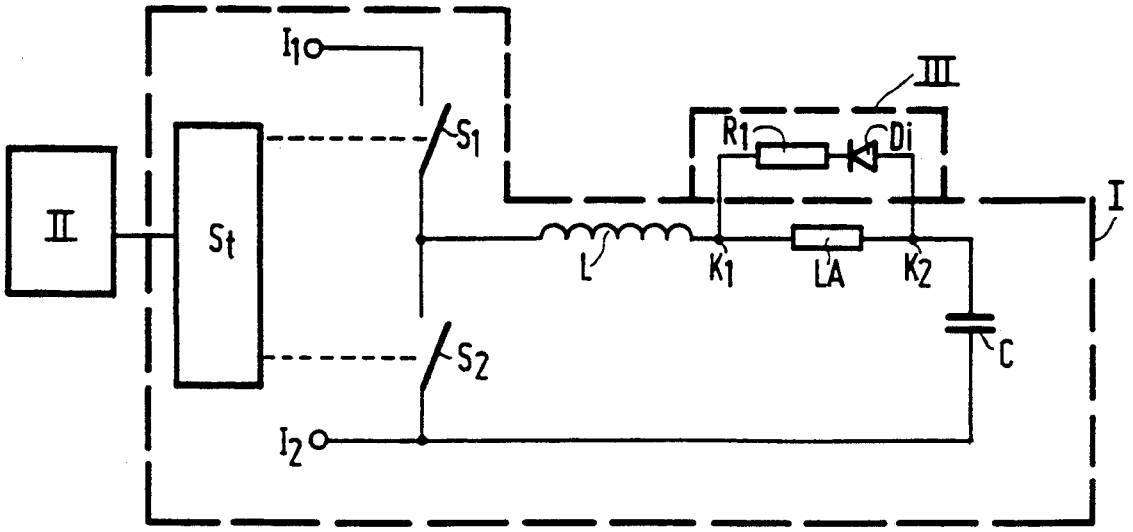
Figure 2B:
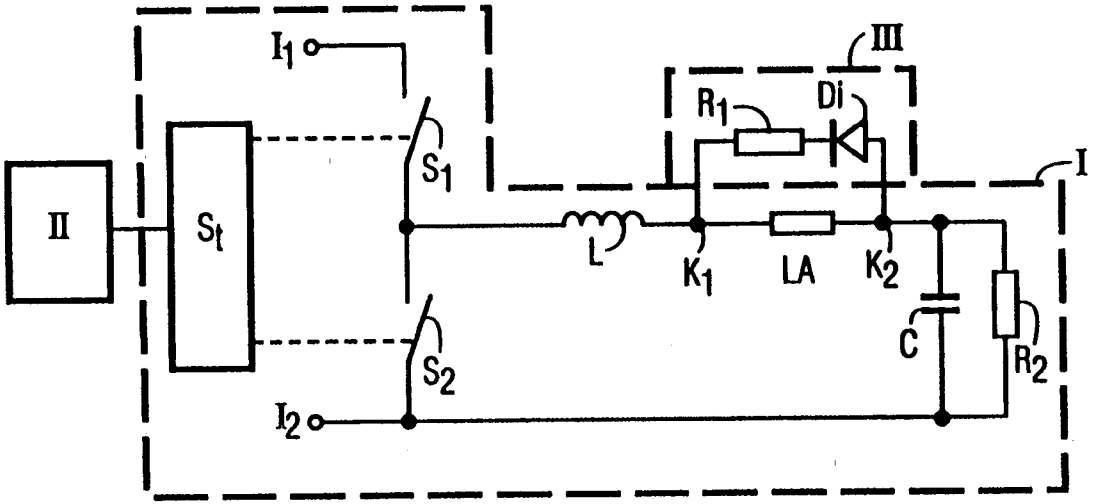

FIG. 2*b* is a combination of FIG. 2*a* and FIG. 3.

FIG. 4 shows the amplitude ILA-DC of the direct current through a low-pressure mercury discharge lamp required for rendering striations substantially invisible as a function of the duty cycle D of the substantially square-wave voltage, the low-pressure mercury discharge lamp being operated by a circuit arrangement as shown in FIG. 2*a*. The amplitude ILA-DC is expressed in mA and the duty cycle D in percents. The low-pressure mercury discharge lamp contained krypton and its power rating was 32 W. The points in FIG. 4 were measured at an ambient temperature of approximately 295 K, while the low-pressure mercury discharge lamp burned in the non-dimmed state. It is evident that a direct current of approximately 4.5 mA is required for rendering striations substantially invisible for a value of the duty cycle D of 49 % and 51%, provided the polarity of the direct current does not correspond to the polarization direction in which the AC component has its greater amplitude. However, if the polarity of the direct current corresponds to the polarization direction in which the AC component has its greater amplitude, a direct current of less than 1.5 mA will suffice. It can also be seen that the required direct currents are situated symmetrically relative to the point (D=50%, ILA-DC=0 mA).

Apart from the test results shown in FIG. 4, it was found to be possible to render striations invisible in the low-pressure mercury discharge lamp containing krypton over a range of powers consumed by the lamp from 10% to 100% of the rated power. When the duty cycle D was chosen between 43% and 57%, and the polarity of the direct current coincided with the polarization direction of the smaller of the two amplitudes A1 and A2, a direct current of approximately 14 mA was necessary to achieve this purpose. Such a high direct current gives rise to a comparatively high power dissipation and in addition to cataphoresis in the lamp. Such a high direct current is undesirable for these two reasons. When on the other hand the polarity of the direct current coincided with the polarization direction of the greater of the two amplitudes A1 and A2, it was found to be possible to render striations invisible at the same values of the duty cycle D and of the power consumed by the lamp by means of a direct current of no more than approximately 1.5 mA, so that power dissipation as a result of this direct current is comparatively low and cataphoresis does not occur in the lamp to any noticeable extent, so that the invisibility of striations is realized in an efficient manner.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which as a matter of language might be said to fall therebetween.

I claim:

1. A circuit for generating a high frequency current having a DC component and a high frequency AC component for operating a discharge lamp, said circuit comprising:

means for generating the DC component having a DC amplitude and a polarization direction with respect to a zero reference level; and means for generating an asymmetric high frequency AC component, asymmetric about the DC component, the AC component having a first amplitude in a first polarization direction and a second amplitude in a second, opposite polarization direction, one of the AC amplitudes being greater than the other AC amplitude with respect to the DC component, and the greater of the amplitudes having a polarization direction coincident with the polarization direction of the DC component.

2. A circuit as claimed in claim 1, wherein said means for generating the high frequency AC component comprises switching means for generating a substantially square-wave voltage having a duty cycle, and asymmetry means for rendering the duty cycle unequal to 50%.

3. A circuit as claimed in claim 2, further including a load branch coupled to said switching means and comprising a series circuit of a capacitor and lamp connection terminals.

4. A circuit as claimed in claim 3, further including wherein said capacitor is coupled in series with said lamp connection terminals, and a branch comprising an impedance shunts said capacitor.

5. A circuit as claimed in claim 3, wherein said means for generating the DC component includes a DC branch which shunts said lamp connection terminals and comprising a series circuit of an impedance and a unidirectional element.

6. A circuit as claimed in claim 1, further comprising lamp connection terminals for coupling the AC and DC current components to the discharge lamp and wherein the means for generating the DC component includes a DC branch which shunts said lamp connection terminals and comprising a series circuit of an impedance and a unidirectional element.

7. A circuit as claimed in claim 6, further comprising a capacitor coupled in series with said lamp connection terminals.

8. A circuit as claimed in claim 7, wherein an impedance shunts said capacitor.

9. A circuit as claimed in claim 1, further comprising lamp connection terminals for coupling the AC and DC current components to the discharge lamp, and a capacitor coupled in series with the lamp connection terminals, said means for generating the DC component including an impedance which shunts said capacitor.

10. A circuit for generating a high frequency current having a DC component and a high frequency AC component for operating a gas discharge lamp, said circuit comprising:

DC generating means for generating the DC component having a DC amplitude and a polarization direction with respect to a zero-reference level, and including a diode having an anode and a cathode;

switching means including two switching elements, for generating the high frequency AC component, the AC component having a substantially square wave voltage with a duty cycle below 50%, said switching means coupled to said cathode of said diode;

asymmetry means for generating a first amplitude of the high frequency AC component in a first polarization direction and a second amplitude of the high frequency AC component in a second polarization direction, the second amplitude being greater than the first amplitude with respect to the DC component, the high frequency AC component being asymmetric about the DC component and the second polarization direction being coincident with the polarization direction of the DC component; and a load branch coupled to said switching means and, including a capacitor coupled to said anode of said diode, and lamp connection terminals.

11. A circuit for generating a high frequency current having a DC component and a high frequency AC component for operating a gas discharge lamp, said circuit comprising:

DC generating means for generating the DC component having a DC amplitude and a polarization direction with respect to a zero-reference level, and including a diode having an anode and a cathode;

switching means including two switching elements, for generating the high frequency AC component, the AC component having a substantially square wave voltage with a duty cycle above 50%, said switching means coupled to said anode of said diode;

asymmetry means for generating a first amplitude of the high frequency AC component in a first polarization direction and a second amplitude of the high frequency AC component in a second polarization direction, the second amplitude being greater than the first amplitude with respect to the DC component, the high frequency AC component being asymmetric about said DC component and the second polarization direction being coincident with the polarization direction of the DC component; and a load branch coupled to said switching means and including a capacitor coupled to said cathode of said diode, and lamp connection terminals.

12. A circuit for generating a high frequency current having a DC component and a high frequency AC component for operating a gas discharge lamp, said circuit comprising:

DC generating means for generating the DC component having a DC amplitude and a polarization direction with respect to a zero-reference level, and including a resistor;

switching means including two switching elements, for generating the high frequency AC component, the AC component having a substantially square wave voltage with a duty cycle below 50%;

asymmetry means for generating a first amplitude of the high frequency AC component in a first polarization direction and a second amplitude of the high frequency AC component in a second polarization direction, the second amplitude being greater than the first amplitude with respect to the DC component, the high frequency AC component being asymmetric about the DC component and the second polarization direction being coincident with the polarization direction of the DC component; and a load branch coupled to said switching means and including a capacitor which is shunted by said resistor, and lamp connection terminals.

* * * * *